US007115053B2

(12) United States Patent
Meichner

(10) Patent No.: US 7,115,053 B2
(45) Date of Patent: Oct. 3, 2006

(54) SPORT OR GAME GOAL POST VISUAL AID SYSTEM AND METHOD FOR USING THE SAME

(76) Inventor: Robert Meichner, 8050 Springrun Rd., Fairhope, AL (US) 36532

( * ) Notice: Subject to any disclaimer, the term of this patent is extended or adjusted under 35 U.S.C. 154(b) by 6 days.

(21) Appl. No.: 10/834,204

(22) Filed: Apr. 29, 2004

(65) Prior Publication Data

US 2005/0242508 A1 Nov. 3, 2005

(51) Int. Cl.
*A63B 63/00* (2006.01)

(52) U.S. Cl. ..... 473/477; 473/478; 273/402

(58) Field of Classification Search ..... 273/398–402; 473/476–478, 462, 467

See application file for complete search history.

(56) References Cited

U.S. PATENT DOCUMENTS 3,586,326 A * 6/1971 McKenna ..... 473/477
4,014,117 A 3/1977 Vallillee
4,026,554 A * 5/1977 Karkoska ..... 473/477
5,305,998 A * 4/1994 Nesbit et al. ..... 473/481
5,816,947 A 10/1998 Kavitch
5,947,846 A * 9/1999 Craig ..... 473/478
6,070,879 A 6/2000 Kemp
6,135,456 A * 10/2000 Cooper ..... 273/371
2004/0043843 A1* 3/2004 Ryan ..... 473/476

OTHER PUBLICATIONS

Samuel M. Goldwasser, "Argon/Krypton Ion Lasers", Sam's Laser FAQ, www.repairfaq.org/sam/laserarg.htm, pp. 1-76.
Spring et al., "Argon-Ion Lasers", Olympus Microscopy Resource Center, www.olympusmicro.com/primer/java/lasers/argonionlaser/index.html; pp. 1-2.
Spring et al., "Sources of Visible Light", Olympus Microscopy Resource Center, www.olympusmicro.com/primer/lightandcolor/lightsourceshome.html, pp. 1-3.
Spring et al., "Introduction to Lasers", Olympus Microscopy Resource Center, www.olympusmicro.com/primer/lightandcolor/lasersintro.html, pp. 1-13.
Spring et al., "Diode Lasers", Olympus Microscopy Resource Center, www.olympusmicro.com/primer/java/lasers/diodelasers/index.html, pp. 1-7.
Spring et al., "Light Emitting Diodes", Olympus Microscopy Resource Center, www.olympusmicro.com/primer/java/leds/basicoperation/index.html, pp. 1-3.
Akiyama et al., "Intense Visible Light Emission from Stress-Activated $SrMgAl_6O_{11}$:Eu", Physics Finder, http://content.aip.org/applab/v83/i4/650_1.html, pp. 1-3.

(Continued)

*Primary Examiner*—Mark S. Graham
(74) *Attorney, Agent, or Firm*—Reed Smith LLP; Stanley P. Fisher, Esq.; Juan Carlos A. Marquez, Esq.

(57) ABSTRACT

A sport or game goal visual aid system includes a visible light assembly that provide a pair of angular visible light coverages next to the goal post (only outside of the goal opening) or a visible light mesh/grid only over the goal opening.

3 Claims, 6 Drawing Sheets

OTHER PUBLICATIONS

Braun et al., "Visible Light Emission from Semiconducting Polymer Diodes", Physics Finder, http://content.aip.org/APPLAB/v58/i18/1982_1.html, pp. 1-10.

Estes et al., "Processes of Efficient Visible Light Emission in Silicon Nanostructures", Storming Media, http://www.stormingmedia.us/13/1398/A139803.html, 1 page.

Cullis et al., "Visible Light Emission Due to Quantum Size Effects in Highly Porous Crystalline Silicon", Nature 26, Sep. 1991, http://www.nature.com, 1 page.

Samuel M. Goldwasser, "Solid State Lasers", Sam's Laser FAQ, www.repairfaq.org/sam/laserss1.htm, pp. 1-212.

* cited by examiner

SPORT OR GAME GOAL POST VISUAL AID SYSTEM AND METHOD FOR USING THE SAME

BACKGROUND OF THE INVENTION

1. Field of the Invention

The invention generally relates to a sport or game goal visual aid system which includes a visible light assembly that provides a pair of angular visible light coverages next to the goal post (only outside of the goal opening) or a visible light mesh/grid only over the goal opening. More particularly, the present invention relates to a sport or game goal visual aid system having a sport or game goal with a frame defining a goal opening, and at least one pair of visible light emitters mounted on two opposite sides of the frame for providing two angular visible light beams outside of the opening or a visual light mesh/grid covering the opening.

2. Description of Related Arts

The world-wide football playing population has been growing with an enormous amateur and college football system of leagues and coaching. There are about 1,200 players under contract in the NFL. A football goal post includes two vertical posts connected by a horizontal cross bar to define a generally U-shaped goal area. The U-shaped structure is supported by a goose neck to the ground. The dimensions of a football goal post are specifically defined by the rules of the particular football league for which the goal post will be used. For example, the official football posts for high school teams are made of 4½" OD round steel support with 5' set back, and the crossbar is 3½" OD round steel and uprights are 2" OD steel. The posts are designed to prevent support from turning.

There have been many improvements to the physical shapes and/or functions of a goal post. U.S. Pat. No. 6,394,917 shows a goal post with adjustable components. U.S. Pat. No. 6,220,976 shows a modified goal post. U.S. Pat. No. 5,280,904 shows a football goal post and net display apparatus. U.S. Pat. No. D308,555 shows a mini goal post. U.S. Pat. No. D304,059 shows a pyramid ball goal post. U.S. Pat. No. 4,535,988 shows a football goal post with an explosive-type souvenir projector. U.S. Pat. No. D250,283 shows a goal post structure, and U.S. Pat. No. 3,981,501 shows a retractable goal post. However, these improvements do not help the audience better perceive the occurrence of scoring events, such as touchdowns, extra points, and the two-point conversions.

Currently, the audience rely upon human eyes and cameras on site to capture the moment when the ball passes through the U-shaped goal area. There is a need for an assisting mechanism to better perceive the occurrence of scoring events.

Many sensors have been used in place of human eyes for detecting moving objects. U.S. Pat. No. 6,294,910 shows a digital position sensor for sensing the position of a moving target, such as a vehicle, a robot, or a machine tool, rather than for sensing a ball passing a goal post. A digital sensor of this type can be mounted in the bearings of an automobile steering column in order to check the path of the vehicle, or in systems for checking or controlling the position of a robot or of a machine tool, for example.

U.S. Pat. No. 6,579,190 shows a swinging speed measuring sensor which outputs a trigger signal for opening/closing the shutter to the CCD camera when the swinging speed measuring sensor detects the passage of a golf club rather than the golf ball. Upon receipt of the trigger signal, the multi-shutter opens and closes successively. Synchronously with the opening/closing of the multi-shutter, the strobes emit flashlight sequentially. In this manner, a plurality of images of a golf ball driven by the golf club are photographed in a one-image frame.

U.S. Pat. No. 5,255,916 shows an optical ball sensor for detecting a rolling pinball on an inclined surface, rather than a ball passing over an open field and through a goal post.

U.S. Pat. Pub. No. 20030181268 provides an electronic sound effect assembly via a sensor on a sports goal net, rather than on the goal hoop/post. In addition, the sound effect assembly is activated to generate audible sounds, preferably that of a cheering crowd.

U.S. Pat. No. 4,014,117 shows a visual aid for football spectators that includes red and green lights on poles associated with a particular game object, which are selectively energized by a remote control by a referee or official scorer to indicate the success or failure to achieve the particular game object. The lights are manually or selectively turned on/off, rather than always turned on. In addition, the lights only show whether a scoring attempt was successful, but do not illuminate the goal post or show the passing position of the ball.

U.S. Pat. No. 5,816,947 shows a signaling apparatus attached to the hockey net so as to energize a light siren when a playing piece passes through the goal opening and impacts the net. However, the light only indicates whether a scoring attempt was successful, but does not illuminate the goal post or show the passing position of the playing piece.

Currently, a more exciting visualization system for sports scored by a goal post, such as football, basketball, etc. is needed in assisting the audience to better perceive the occurrence of scoring events and to attract more people to the sports.

SUMMARY OF THE INVENTION

It is an object of the present invention to provide visual aids for sport or game goals when a moving playing object passes the goal opening.

It is a further object of the present invention to provide a visual aids which to enhance the excitement of sports or games, and therefore, attract more people.

It is another purpose of this invention to provide a system for automatically sensing and showing a moving playing object passing the goal opening.

BRIEF DESCRIPTION OF THE DRAWINGS

The foregoing and additional features and characteristics of the present invention will become more apparent from the following detailed description considered with reference to the accompanying drawings in which like reference numerals designate like elements and wherein.

DESCRIPTION OF THE PREFERRED EMBODIMENTS

The sport or game goal visual aid system of the invention includes a sport or game goal with a frame defining a goal opening, at least one pair of visible light emitters mounted on two opposite sides of the frame for providing crisscrossing visible light beams into a visible light mesh or grid covering the opening. Additionally, a pair of visible light detectors are mounted on the two opposite sides of the frame corresponding to the emitters for receiving the visible light mesh or grid covering the opening thereby determining whether a moving playing object passes via the opening. Optionally, a sounding device is activated by the receivers when they determine the moving playing object passed via the opening.

Each pair of the visible light emitters and receivers may be bounded into one optical target sensor with the visible light emitter and light detector mounted on a printed circuit board. When a moving playing object interrupts the visible light beams, a signal is delivered to a microprocessor. The microprocessor is programmed to respond to the signal to score points, to initiate other play features and the like. The microprocessor can stand along by itself or mounted on the circuit board with one of the sensors in the same package.

Figure 1:
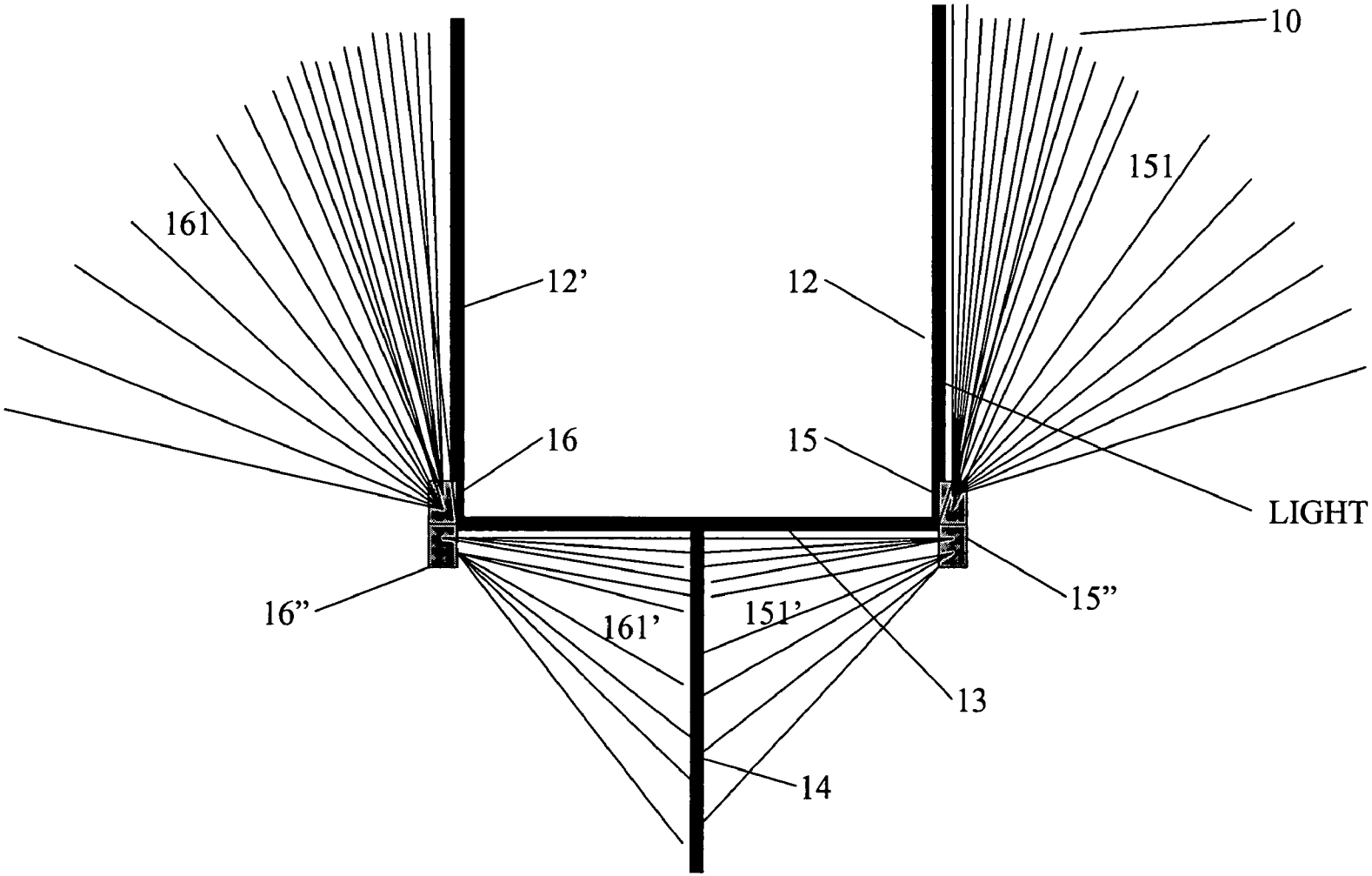
FIG. 1 illustrates a first embodiment of a football goal visual aid system according to the present invention.
Figure 2:
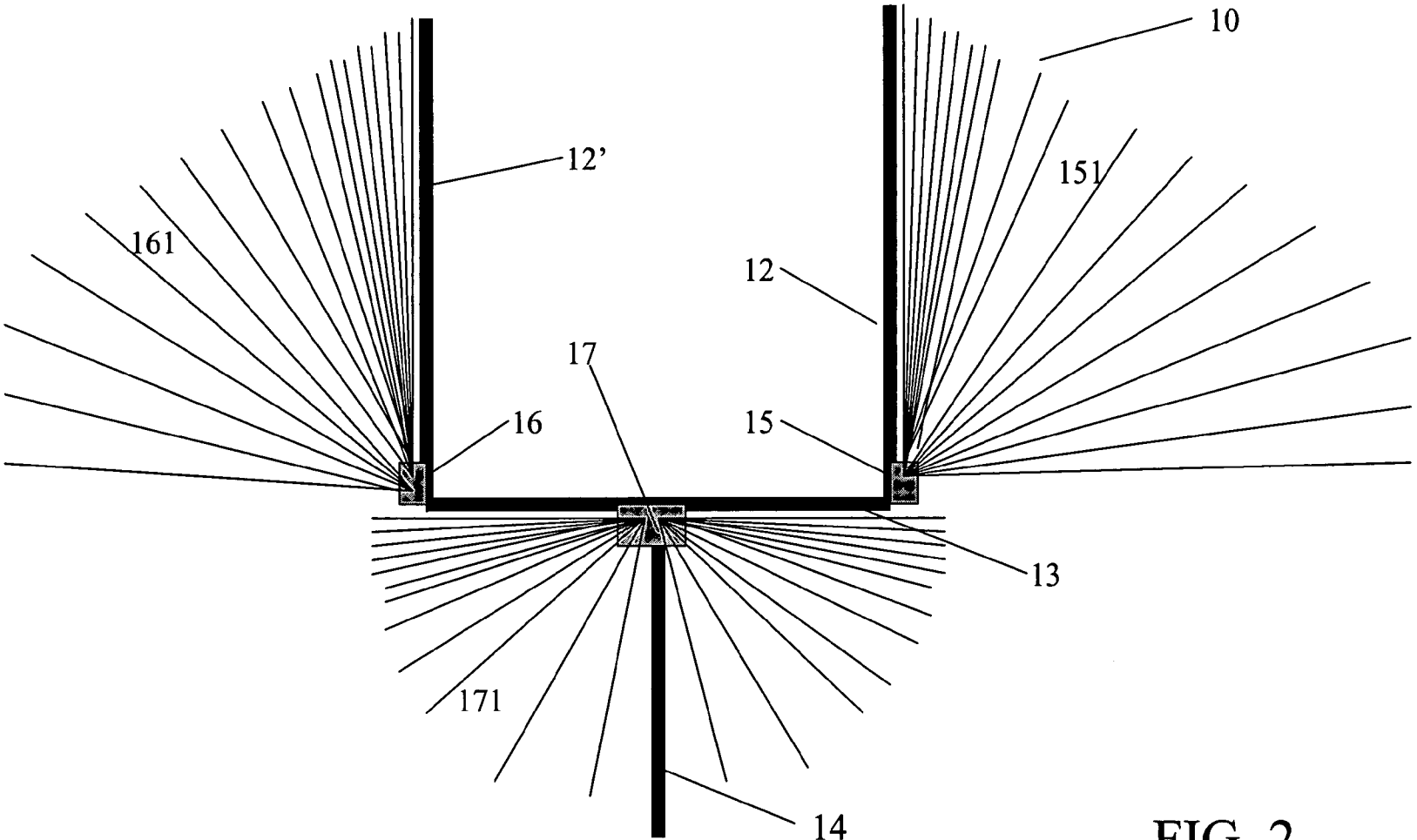
FIG. 2 illustrates a modification of the first embodiment of a football goal visual aid system of FIG. 1.

The sport or game goal visual aid system of the invention is applied to football goal post as shown in FIG. 1. The football goal visual aid system 10 includes a pair of goal posts 12, 12', a crossbar 13 connecting the goal posts 12, 12' to form a generally U-shaped frame, a gooseneck connected with the crossbar 13 to support the frame on the ground, and a pair of visible light emitters 15, 16, such as solid state laser devices, mounted on (1) the top end of the goal posts 12, 12' for emitting two wide-angle visible beams 151, 161 (FIG. 1), or (2) the top end of the goal posts 12, 12' for emitting crisscrossing light beams 152, 162 (FIG. 2). The fan shape coverage of each of the wide-angle visible beams 151, 161 may also be covered by a plurality of focused visible light beams radiated from an emitter.

To contrast the position of the crossbar 13, a second pair of emitters 15', 16' are mounted at two ends of the crossbar 13 for emitting two wide-angle visible beams 151', 161' (FIG. 1) so as to provide two fan-shaped coverage in a way similar to the emitters 15, 16. Alternatively, an emitter 17 is mounted approximately at the middle point of the crossbar 13 so as to provide a 180-degree fan-shaped or augural coverage (FIG. 2) with stronger intensity closer to the crossbar 13.

A beam spread indicates the opening angle of the laser beam. A beam spread of 1 mrad corresponds to an increment in the beam radius of 1 mm per Meter of beam length. The spread of the laser beam is measured as an angle, A, usually in radians or milliradians. The angular spread of the beam is simply the diameter of the beam, d, divided by the distance to the screen, D. A=d/D. The above-mentioned wide angle ranges between 0–180 degrees and can be determined according to the size of the goal post to provide the best visual effect. If the emitter is mounted at a corner where the right or left side of frame 12, 12' connecting the crossbar 13, e.g., emitters 15, 15' 16, 16' of FIG. 1, the angular coverage may be 0–90 degrees, and preferably 15–30 degrees, with stronger intensity closer to the frame. If the emitter is mounted at approximately the middle point of the right or left side of the frame, e.g., emitters 15, 16, 17 in FIG. 3, the angle coverage is preferably 180 degrees. The light stronger in the angular coverage is stronger closer to the frame so as to contrast the position of the goal opening.

It is apparent that the emitters can be mounted on different positions of the frame depending on the beam width of the laser and their relative positions. A laser array can be symmetrically arranged on the frame to provide a plurality of visible light beams into a mesh or grid such that when a playing object passes via the goal opening, the audience can better perceive the passing position. This arrangement allows the emitters to be used in different applications, such as hockey, soccer, etc. Where the various sport or game designs necessitate that the width between the light beams be different without having to use different strength emitters for each application. It is also possible to provide the visible light mesh or grid via one single device mounted on one corner of the frame.

Ion gas lasers are generally used for large scale light shows as well as in some types of high performance phototypesetters or other digital image devices, and for use in holography and other optics research. For example, an argon-ion laser produces up to 100 watts of continuous-wave power with the output concentrated into several strong lines (primarily the 488 and 514.5 manometer transitions) each of which has a gain bandwidth in the order of 2.5 GHz. Argon-ion gas laser discharge tubes operate at gas pressures of approximately 0.1 torr with a life span between 2000 and 5000 hours. However, argon ion lasers require significant amount of maintenance and conditioning to achieve optimal output power and maximize tube life. The basic tubes and power supply are costly (a few thousand dollars).

Solid state lasers are commonly used in material processing (cutting, drilling, welding, marking, heat treating, etc.), semiconductor fabrication (wafer cutting, IC trimming), the graphic arts (high-end printing and copying), medical and surgical, range finders and other types of measurement, scientific research, entertainment, and many others where high peak power and/or high continuous power are required. Many of the laser projectors for light shows and for other laser displays deploy solid state lasers rather than argon or krypton ion gas lasers. M-1 Nd:YAG lasers (Meredith Instruments) or M-60 ruby lasers are preferred for the invention. The information for choosing of lasers is incorporated here by reference.

The visible light LEDs, or laser diodes, or HeNe lasers are relatively weak such that they are applicable for in-door stadiums and are available from many manufacturers. LEDs are red, green, yellow/orange, blue or white. LEDs are typically used in cameras for viewfinder data displays, for blinking red self-timer countdown lights and for red AF assist lights. LEDs based on silicon are widely applied in both VLSI and display technologies, but silicon normally emits only extremely weak infrared photoluminescence because of its relatively small and indirect band gap. The more efficient and multicolor (red, orange, yellow and green) visible light emission from highly porous, electrochemically etched silicon, or porous and nano-structured silicon are preferred. In addition, any visible light devices currently in the process of development may be used with the invention, such as intense visible light emission from stress-activated $SrMgAl_6O_{11}$:Eu.

Figure 3:
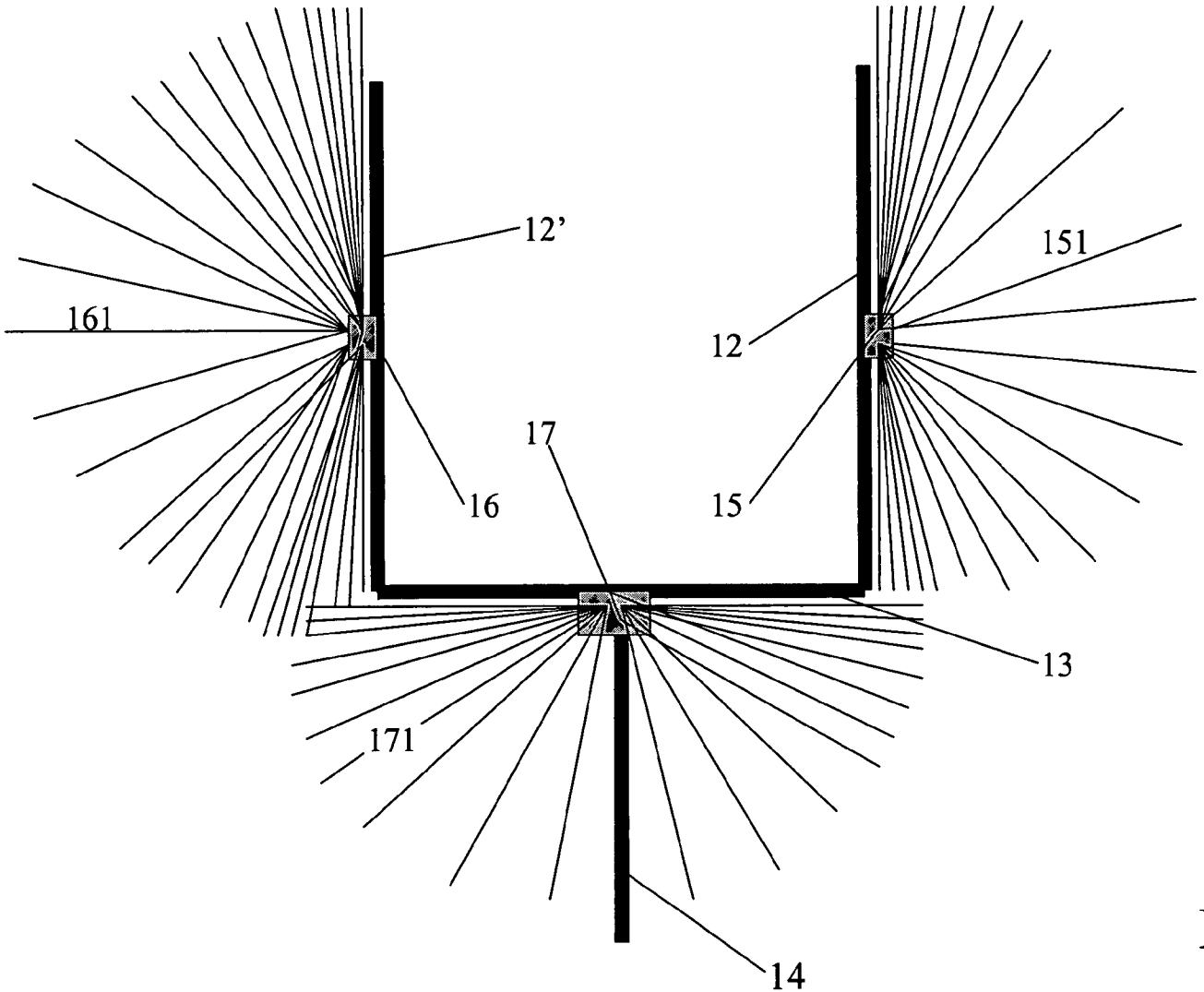
FIG. 3 illustrates another modification of the first embodiment of a football goal visual aid system of FIG. 1.

Referring to FIG. 3, a hockey goal visual aid system 20 of the invention includes a frame, a net (not shown), and a pair of visible light emitters 25, 26, such as solid state laser devices, mounted on the top of the frame for emitting crisscrossing light beams. Preferably, the net is made of a translucent material such that its existence will not compete with the visibility of the visible beams. The details of the visible light emitters are similar to the ones of the football goal visual aid system 10. The frame includes a pair of spaced apart and vertically oriented lateral legs 22, 22' and also a central vertical leg 24 which are connected by a horizontal bar 23 at their top ends and a supporting U-shaped bar 27 at their lower ends. The legs 22, 22' and the horizontal bar 23 define a goal opening. The net is fixed to the frame for defining a defensive space within the goal.

Figure 4:
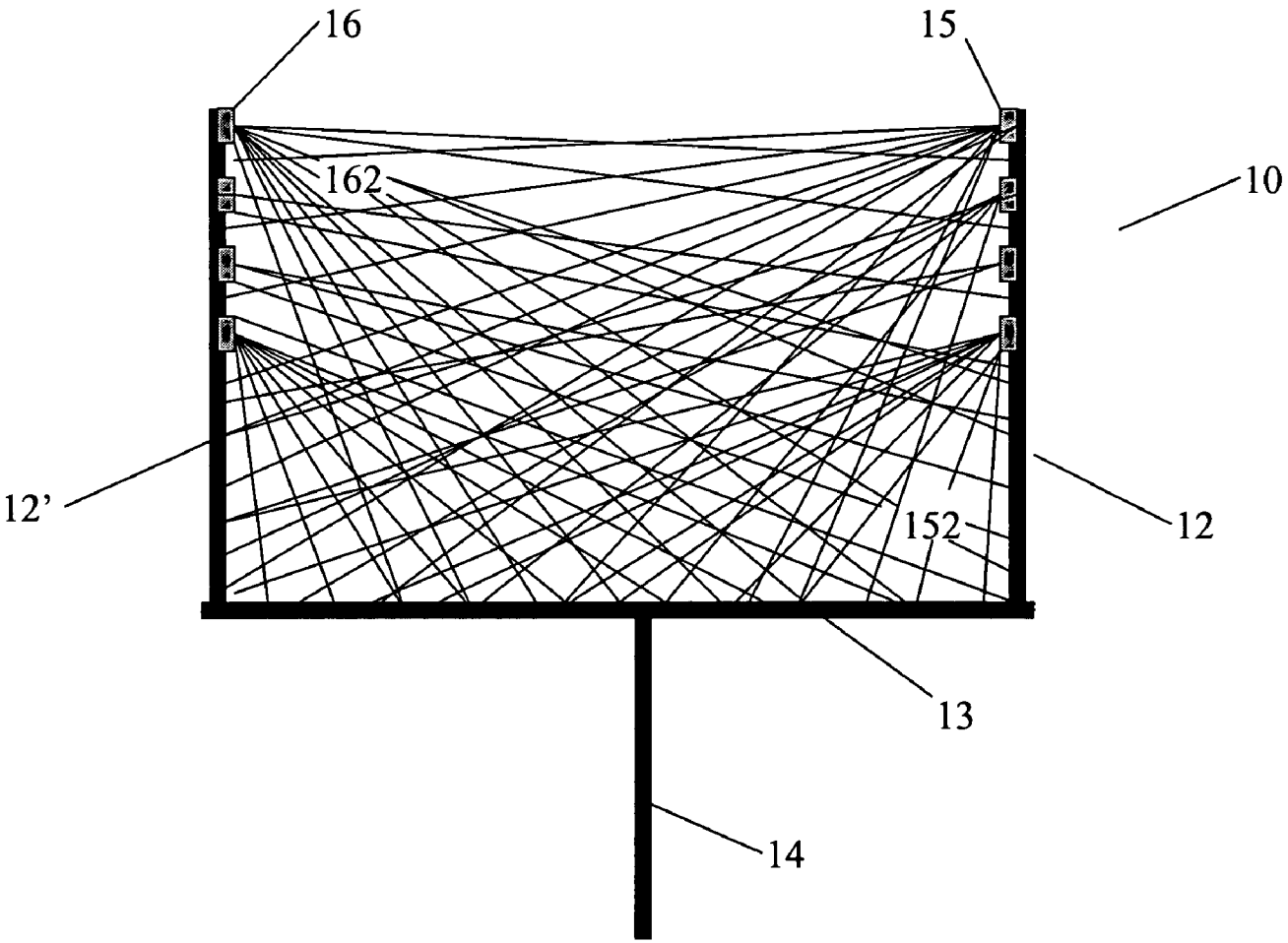
FIG. 4 illustrates a second embodiment of a football goal visual aid system according to the present invention.
Figure 5:
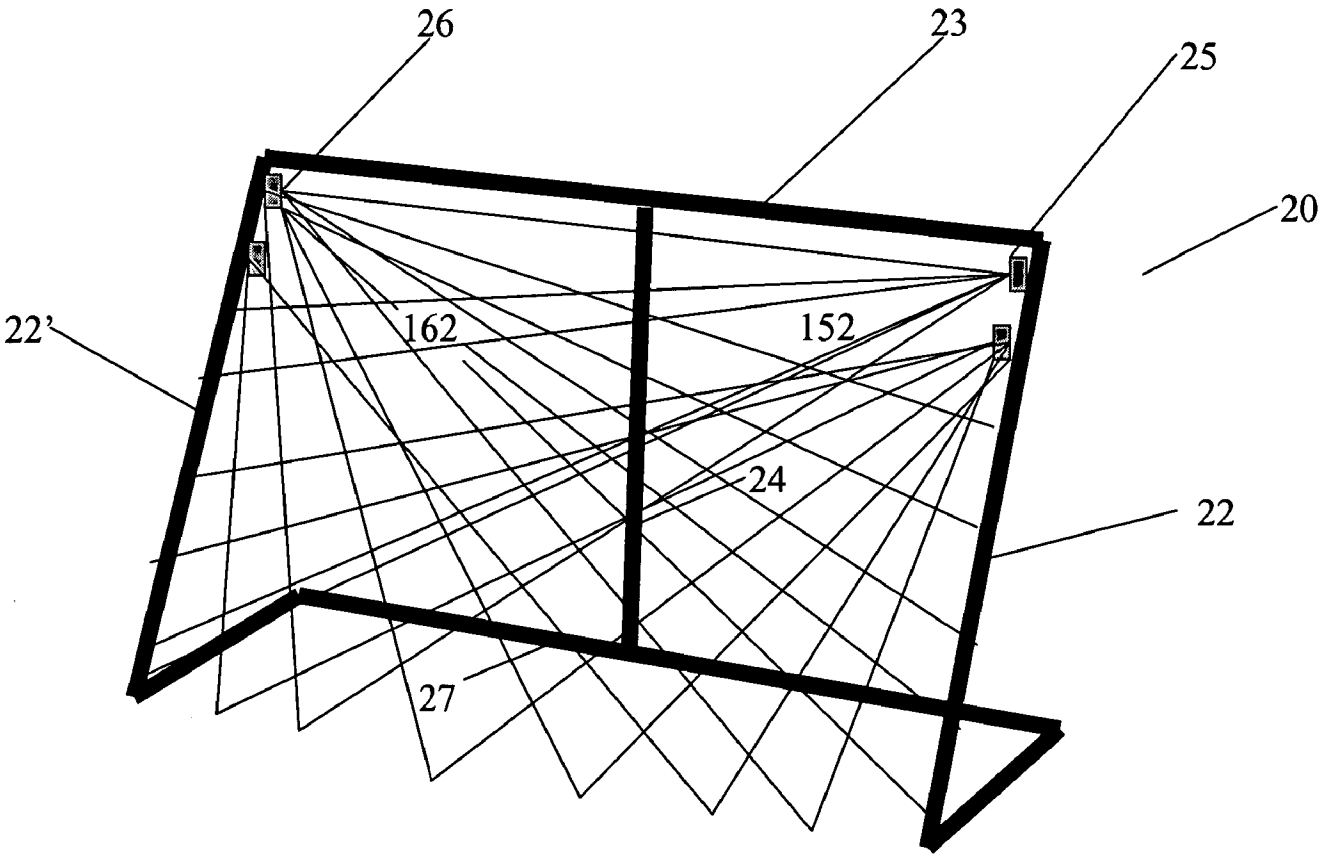
FIG. 5 illustrates a hockey goal visual aid system according to the present invention.
Figure 6:
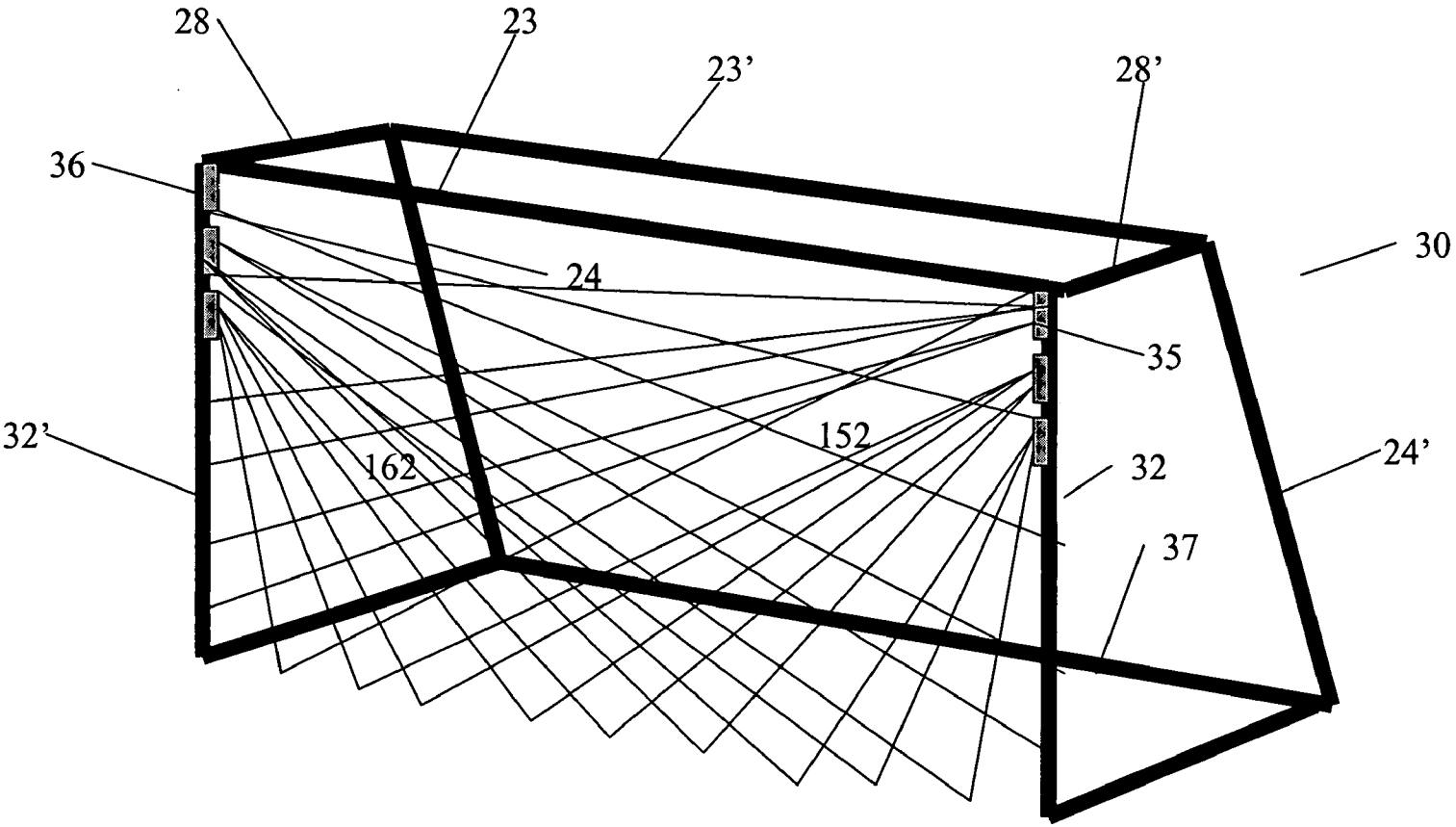
FIG. 6 illustrates a soccer goal visual aid system according to the present invention.

Referring to FIG. 4, a soccer goal visual aid system 30 of the invention includes a frame, a net (not shown), and a pair of visible light emitters 35, 36, such as solid state laser devices, mounted on the top of the frame for emitting crisscrossing light beams. The details of the visible light emitters and the frame are similar to the ones of the hockey goal visual aid system 10.

The principles, preferred embodiments and modes of operation of the present invention have been described in the foregoing specification. However, the invention which is intended to be protected is not limited to the particular embodiments disclosed. The embodiments described herein are illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A sport or game goal visual aid system comprising:

a sport or game goal with a frame defining a goal opening;

at least a pair of visible light emitters mounted on both right and left sides of the frame each for providing an angular light coverage next to the respective side of the frame on a plane parallel with the goal opening and only outside of the goal opening; and at least a third visible light emitter mounted on a crossbar of the frame for providing an angular light coverage only outside of the goal opening.

2. The sport or game goal visual aid system according to claim 1, wherein an angle of the angular light coverage is between 0–180 degrees.

3. The sport or game goal visual aid system according to claim 1, wherein an angle of the angular light coverage is between 15–30 degrees.

* * * * *